United States Patent [19]

Diston

[11] Patent Number: 5,048,710

[45] Date of Patent: Sep. 17, 1991

[54] WET COVER FOR WALLPAPER PASTE DISPENSERS

[76] Inventor: Ava Diston, 15091 Hunter La., Westminster, Calif. 92683

[21] Appl. No.: 468,183

[22] Filed: Jan. 22, 1990

[51] Int. Cl.[5] ..... B65D 51/00

[52] U.S. Cl. ..... 220/212; 206/205; 150/154; 150/165; 383/75; 383/113; 383/902

[58] Field of Search ..... 220/200, 212; 206/205; 150/154, 156, 158, 159, 160, 162, 165; 383/71, 72, 75, 109, 113, 902

[56] References Cited

U.S. PATENT DOCUMENTS

| | | | |
|---|---|---|---|
| 893,759 | 7/1908 | Thomas | 383/113 X |
| 3,962,554 | 6/1976 | Eigel | 206/205 X |
| 4,382,507 | 5/1983 | Miller | 206/205 X |
| 4,629,064 | 12/1986 | Barnes | 383/113 X |
| 4,890,936 | 1/1990 | Cooper | 383/113 X |

*Primary Examiner*—Stephen Marcus
*Assistant Examiner*—Nova Stucker
*Attorney, Agent, or Firm*—Michael R. Collins

[57] ABSTRACT

The wet cover for wallpaper dispensers is a snug fitting cover that includes a moisture source that prevents drying of wallpaper paste when a wallpaper dispenser is covered with the invention.

5 Claims, 1 Drawing Sheet

A-A

WET COVER FOR WALLPAPER PASTE DISPENSERS

BACKGROUND OF THE INVENTION

1. Field of Invention

The wet cover for wallpaper paste relates to a device for covering wall paper paste dispensers or similar devices to allow the dispenser to be not cleaned and still be immediately useable the next day.

2. Description of Prior Art

Currently wallpaper paste dispenser covers usually consist of towels that hold water and maintaining the paste in a wet condition. These often contact the paste, dry out themselves, or allow the paste to solidify.

SUMMARY OF OBJECTIVES OF THE INVENTION

The objective of the device is to provide a means to allow continual usage of the paste dispensing device without having the paste solidify or dry. In accordance with the description presented other objectives of this invention will become apparent when the description and drawings contained herein are reviewed.

DESCRIPTION OF THE PREFERRED EMBODIMENT

Figure 1:
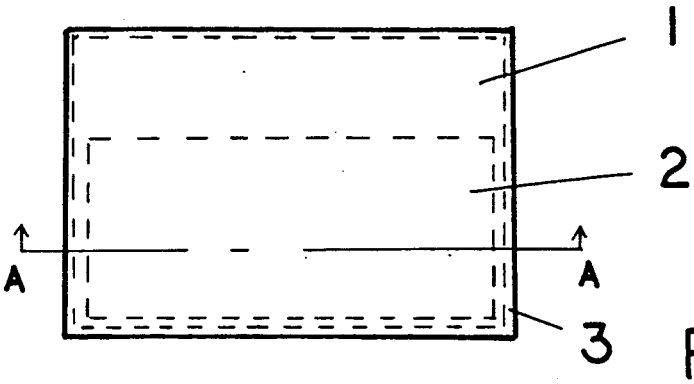
FIG. 1: Illustrates the top view of the invention.
Figure 2:
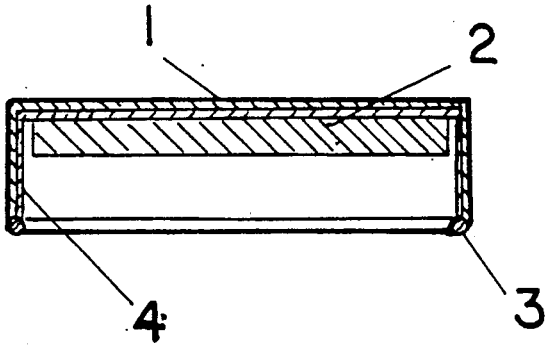
FIG. 2: Illustrates a cross section view of the invention.
Figure 3:
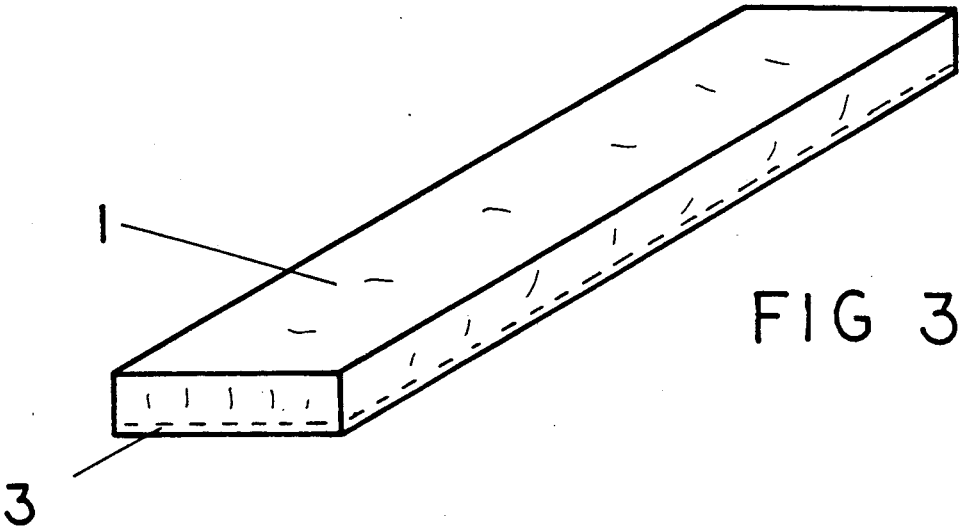
FIG. 3: Illustrates an isometric view of the invention.

Referring to FIGS. 1 through 3 the wet cover for wallpaper paste dispensers is made of a flexible cover (1) that is formed on the sides to loosely fit the dispenser. The flexible cover (1) is made of water resistant material. Nylon fabric has been found to be best suited for this application. A polyurethane fabric backing (4) is affixed to the inside of the flexible cover (1). In practice the polyurethane fabric back (4) permeates the flexible cover (1) to become an integral piece. Attached to the polyurethane backing (4) is a sponge foam strip (2) that covers approximately one third of the depth of the inside of the flexible cover (1) and, is sufficiently long to easily fit inside the interior length of the flexible cover (1). The thickness of the sponge foam strip (2) is sufficient to hold enough moisture to assure adequate moisture to keep the paste wet. Thicknesses of one inch have proven satisfactory for keeping the paste moist for over twenty four hours. An elastic cord (3) is attached to the bottom of the flexible cover (1) to assure that a snug fit is maintained to the wallpaper paste dispenser.

I claim:

1. An open box-like shaped wallpaper paste dispenser cover comprising;

a) a rectangular sheet of flexible water resistant material that is sufficiently large to cover a wallpaper paste dispenser:

b) a water absorbant strip of material attached longitudinally across the sheet of flexible water resistant material and affixed to the side that is intended to be facing the paste of a wallpaper paste dispenser;

c) a cord attached to the perimeter of the flexible water resistant material and of sufficient length to assure a snug fit to a wallpaper paste dispenser.

2. As in claim 1 wherein the flexible water resistant material has an absorbent material laminated on the side intended to be facing the wallpaper paste dispenser.

3. As in claim 2 wherein the absorbent material is polyurethane.

4. As in claim 1 wherein the flexible water resistant material is shaped at the corners to fit snugly over a wallpaper paste dispenser.

5. As in claim 1 wherein the cord attached to the perimeter is elastic.

* * * * *